United States Patent [19]

Taylor

[11] Patent Number: 4,966,311

[45] Date of Patent: Oct. 30, 1990

[54] BULK BAG EMPTYING APPARATUS AND METHOD

[76] Inventor: Murland L. Taylor, Rte. 4, Box 296-A, Parsons, Kans. 67357

[21] Appl. No.: 277,588

[22] Filed: Nov. 29, 1988

[51] Int. Cl.[5] ..... B65D 35/56

[52] U.S. Cl. ..... 222/105; 414/291; 414/403; 414/415; 222/181; 222/196

[58] Field of Search ..... 414/403, 291, 415; 222/105, 181, 183, 199, 196, 108, 152, 185, 416, 460, 543

[56] References Cited

U.S. PATENT DOCUMENTS

| | | | |
|---|---|---|---|
| 3,257,040 | 6/1966 | Dumbaugh et al. | 222/181 |
| 3,924,781 | 12/1975 | Witte | 222/181 |
| 3,961,655 | 6/1976 | Nattrass et al. | 222/181 |
| 4,182,591 | 1/1980 | Stanelle | 414/291 |
| 4,306,668 | 12/1981 | Love | 222/105 |
| 4,518,106 | 5/1985 | LaFleur | 222/105 |
| 4,527,716 | 7/1985 | Haas et al. | 222/105 |
| 4,557,364 | 12/1985 | Ball | 414/291 |
| 4,727,913 | 3/1988 | Bliss | 414/291 |
| 4,790,708 | 12/1988 | Bennigsen-Mackiewicz | 222/181 |
| 4,810,156 | 3/1989 | Pendleton et al. | 414/415 |
| 4,811,889 | 3/1989 | Dackus et al. | 222/108 |

*Primary Examiner*—H. Grant Skaggs
*Attorney, Agent, or Firm*—Head & Johnson

[57] ABSTRACT

Apparatus and method of emptying a material-filled bulk bag of the type having a bottom discharge spout which is releasably closed above a bottom end of the spout being released and opened after the bottom end of the spout is releasably and sealably attached to a material receiving conduit so as to provide a substantially dustless emptying procedure.

1 Claim, 4 Drawing Sheets

BULK BAG EMPTYING APPARATUS AND METHOD

BACKGROUND

A cost-effective method of shipping and storing dry bulk products is to use a large bulk bag, known in the industry as a flexible intermediate bulk container (FIBC). FIBCs eliminate the need for pallets and elaborate packaging and unitizing equipment. Such bulk bags are generally made of plastic fabrics (although burlap and kraft paper are also used). Woven polypropylene is preferred for its low cost and high strength. Nylon or polyester webbing is used to add strength and, with most designs, to serve as sling loops for carrying the bulk bag by fork-lift trucks or suspended by a crane for ship-loading. In those instances where fine particulate material is to be stored, an inner bag liner formed of a plastic such as 1 to 4 mil polyethylene is specified to contain the finer particulates and to protect the product from moisture or contaminates.

Capacities of FIBCs can vary, ranging anywhere from 20 cubic feet to 200 cubic feet. However, most bags are about the same size as a typical pallitized unit load and, when filled, will weigh about one ton. This enables most shippers and users of FIBCs to handle them with existing in-plant equipment such as fork-lift trucks, jib cranes or overhead cranes.

Bulk bags come in a variety of constructions, usually top-filled and bottom discharge although a variety of fill and discharge arrangements are known in the art. Typically, a bulk bag having a discharge spout at its bottom is from ten or fifteen inches in diameter and one to two feet in length. A tie-off/shut-off cord on the shoot is provided at the base of the bag. Once the bag and the bottom discharge shoot is positioned over the container or conduit in which the material is to be emptied, undoing the tie-off cord provides a means for quick release of the material. In many instances, the discharge of the material occurs as the bag is being held by a fork-lift truck or an overhead crane while the bag is opened by an operator therebeneath over a cone-shaped hopper, blender or other container of some sort. After the bag is opened, it is then lowered down into the cone or receiving spout to empty.

SUMMARY OF THE INVENTION

This invention is directed to apparatus and method for discharging bulk or semi-bulk bags.

Another object of the invention is to provide an apparatus and method for emptying and/or discharging material typically fine particles or powder such as talc, flour, clay or starch, also granular material such as salt, grain, feed, seeds and dry chemicals from a bulk bag or semi-bulk bag wherein the bag is vertically supported contiguous, i.e., adjacent and/or resting upon a bottom support pan having a central opening through which the bottom opening mechanisms of the bag are received including a discharge spout. The discharge spout includes a tie-off/shut-off cord positioned above the bottom of the discharge spout or shoot. The bottom end of the spout is first releasably and sealably attached to a material receiving conduit. Thereafter, the tie-off cord is released and the material therein enters the material conveying system or other receptacle.

Specifically the invention is directed to an apparatus to empty a material-filled bulk bag or semi-bulk bag, having a top, bottom and sides forming a vertical rectangular shape. Typically, the preferred bag for use with this invention contains means which forms a bottom discharge end or spout. The apparatus comprises an essentially vertical support frame means with means at the top of the frame to support the bulk bag within the frame. A support pan positioned intermediate the top and bottom within the frame receives the bottom of the bag which may be partially resting thereon. That is, the full weight of the bag is not usually carried by the support pan, only enough weight to create a seal with the bottom of the bag. The support pan has a central opening and a coaxial cylindrical sleeve of larger diameter than the opening extending downwardly from the bottom of the pan. An access opening is provided about a portion of the periphery to provide access for an operator in the use of the invention. A material receiving conduit is coaxially spaced below the central opening and within the sleeve. A means is provided to sealably and releasably attach the bottom end of the discharge spout or shoot to the material receiving conduit. Once the bulk bag is in such position, an operator merely has to release the tie-off cord, allowing the material to enter the material receiving conduit and/or receptacle and/or conveyance to other storage or usage.

DETAILED DESCRIPTION

Before explaining the present invention in detail, it is to be understood that the invention is not limited to its application to the details of construction ana arrangement of parts illustrated in the accompanying drawings, since the invention is capable of other embodiments and of being practiced or carried out in various ways commensurate with the scope and lawful coverage of the claims herein. Also it is to be understood that the phraseology or terminology employed herein is for the purpose of description and not of limitation.

Figure 1:
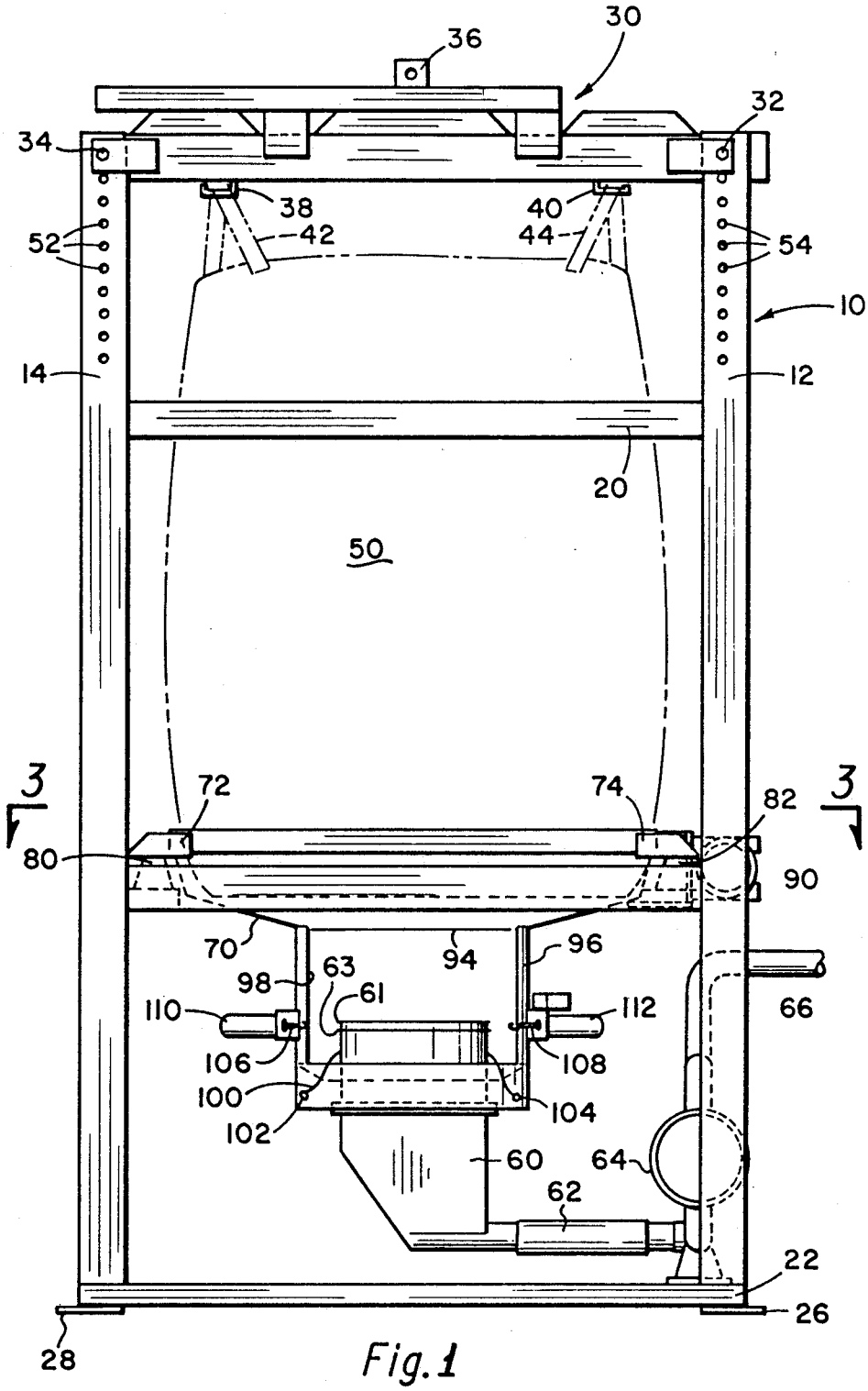
FIG. 1 is a side elevational view of the apparatus of this invention.
Figure 2:
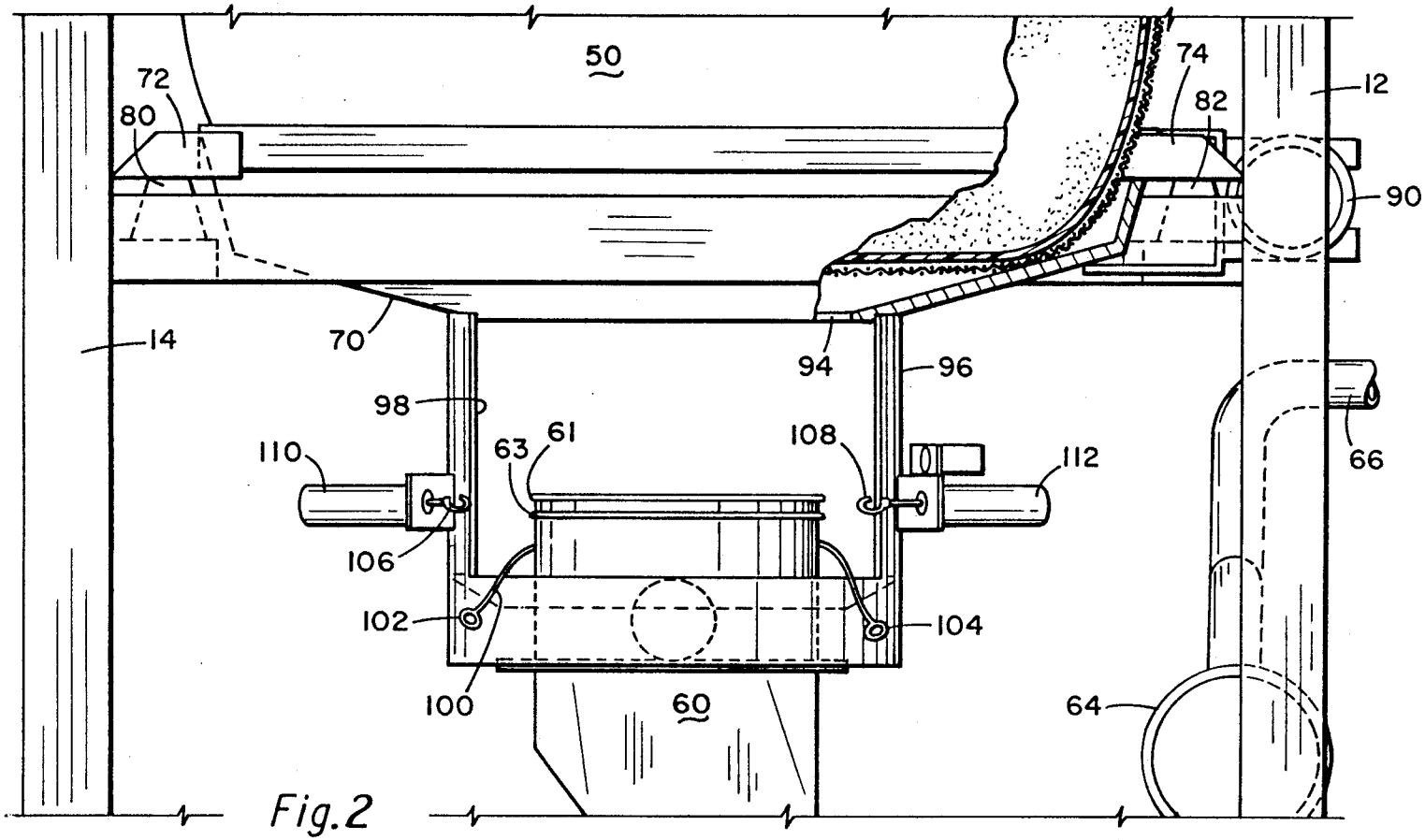
FIG. 2 is a partial side elevational view showing the material discharge system of this invention in enlarged detail.
Figure 3:
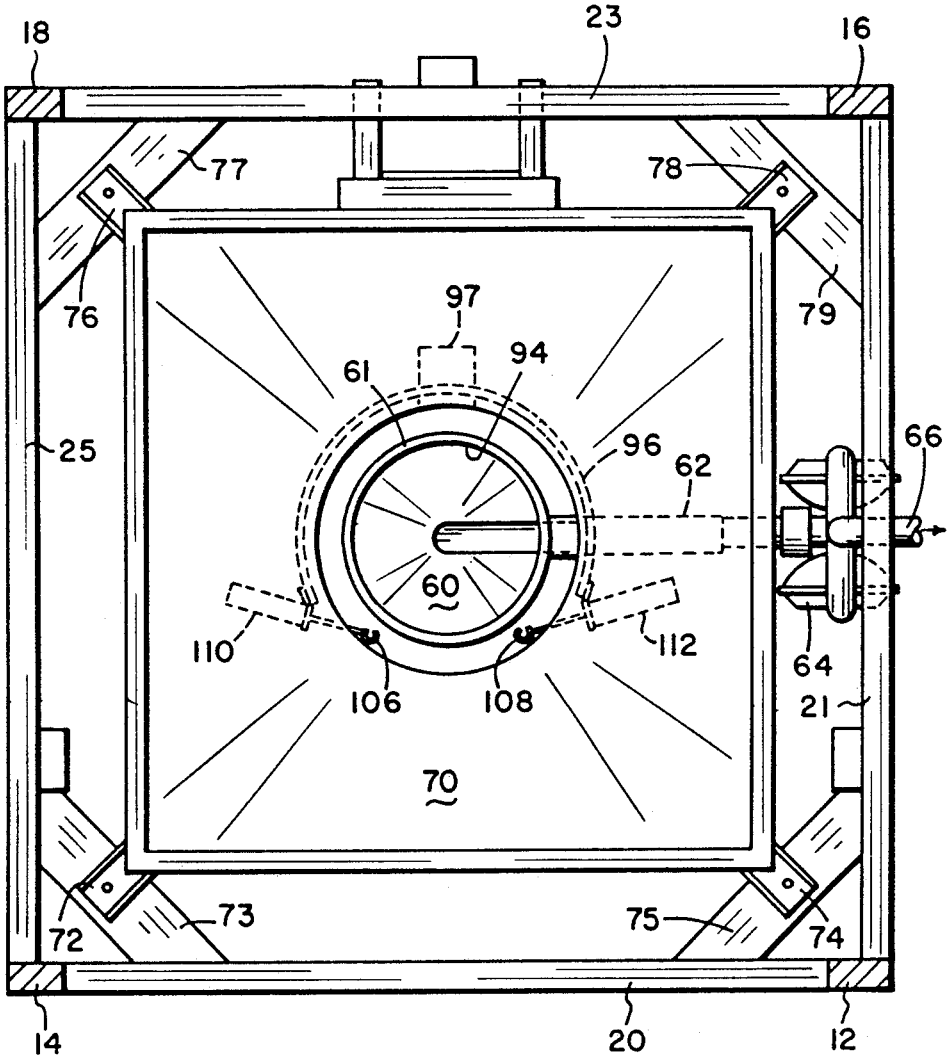
FIG. 3 is a sectional view of the apparatus of this invention taken along the line 3—3 of FIG. 1.
Figure 4:
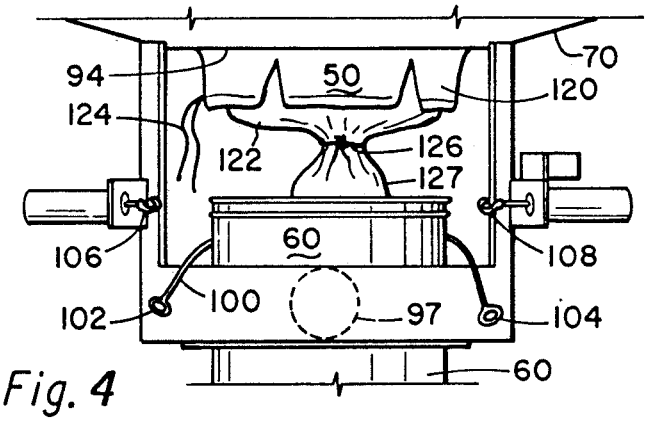
FIGS. 4, 5 and 6 depict the method of use of the apparatus of this invention.
Figure 5:
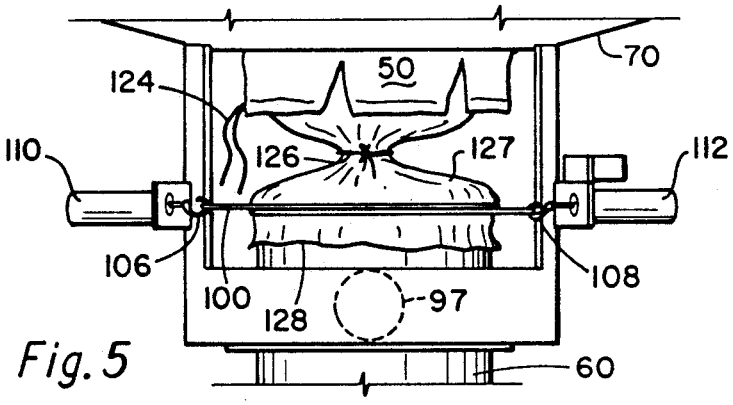
Figure 6:
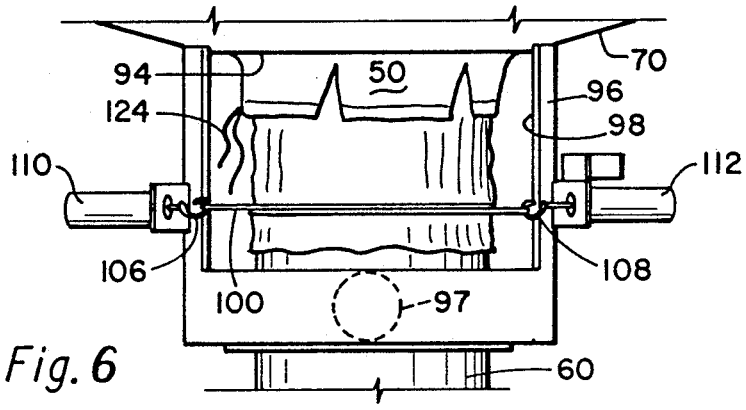

Referring now to the drawings and particularly FIGS. 1, 2 and 3, the apparatus of this invention is generally designated by the numeral 10 and is defined by a rectangular framework formed by four vertical members, 12 and 14 of which are shown in these views while 16 and 18 are shown in FIG. 3. Suitable cross bracing 20, 21 23 and 25 is provided as additional support. Appropriate footings 26 and 28 are provided for supporting the frame upon the floor or ground. At the top of the frame is a framework, generally designated by the numeral 30 which in this embodiment is releasably retained to the top of support legs 12, 14, 16 and 18. The top frame 30 is releasably attached and/or may rest on the vertical framework by bolts such as 32 and 34 (one side only being shown). The top frame 30 has means to make it adaptable to be carried by a fork-lift truck or a crane via attachment means 36 which in turn has appropriate hooks, two of which are shown at 38 and 40, for releasably connecting with lifting slings or loops 42 and 44 respectively usually formed as a part of the bag 50. Depending upon the size of the bulk bag 50 shown dotted, the top support frame may be positioned in any one of the matching openings 52 and 54. It is to be understood, however, that a variety of lift mechanisms e.g. fork lifts, cranes, etc., may be utilized to retain the bulk bag 50 in a position within the frame, or at least above the support pan. Although the bag 50 is shown in FIG. 2 as having two layers, this is not a limiting factor to the use of the invention as a variety of bulk bag constructions are applicable to this invention.

Centrally located at the bottom of the frame is a material receiving conduit 60 which is connected in this embodiment by conduit 62 to a conveying mechanism such as double-acting pump 64, the outlet of which is shown at 66.

Intermediate the framework is a support pan 70 which is attached to the framework via support members 72, 74, 76, and 78 which then rest upon vibration absorbing or dampening devices 80, 82 shown only in FIGS. 1 and 2. A vibrator 90 may be optionally attached to or connected with the pan to assist in the emptying of the material contents where such contents are not free flowing. Such vibrators include a variety of electro-vibrators, air vibrators and/or oscillating cylinders. One preferred vibrator is that manufactured by Vibco, Inc. A central opening 94 is provided within the pan into which the bottom of the pan is tapered forming what is essentially a wide mouth funnel for a bulk bag to be received upon.

A cylindrical sleeve 96 is attached to and extends downwardly from the bottom of the pan and made coaxial with the opening 94. The sleeve 96 is usually larger than the opening. An access opening 98 is formed about a portion of the periphery in order for an operator to work in unloading or emptying the contents of the bulk bag.

At the top of the material receiving conduit 60 is a pair of spaced flanges 61 and 63. A draw cord 100 is provided with end rings 102 and 104 which are attachable to the respective pistons 106 and 108 of pneumatic or hydraulic piston/cylinder means 110 and 112 which are adaptable to draw and/or release a drawstring 100 as it works within the space between the flanges 61 and 63.

A duct work 97 shown dotted in FIG. 3 is attached to the sleeve 96 so as to provide a vacuum means for removing any dust or vapors within the enclosure.

In operation a bulk bag 50 is set within the framework or held in the framework or supported above the support pan 70 by any means such as a forklift truck, overhead crane or other lifting device and positioned so that the bottom end thereof is received upon the support pan. Once the bag is securely supported an operator, working through opening 98, can begin to open the bottom of the bag. In this particular example, the bulk bag comprises an outer cover 120. The outer cover has a releasable closure, i.e., drawstrings 124 which are first released, exposing the discharge spout 122 which is provided with a tie-off cord 126 positioned above the end 128 of the inner liner. The operator will have caused air to be drawn through the enclosure via conduit 97 by a vacuum means to pull any stray dust or vapors away from the operator. The bottom end 128 of the spout is then positioned about the material receiving conduit. Drawstring 100 is then placed into the space between the parallel flanges 61 and 63 with loops 102 and 104 being crossed and respectively retained by hooks 108 and 106. Upon pneumatic or hydraulic action of piston/cylinders 110 and 112, the drawstring is drawn taut, providing a seal of the discharge spout 127 with the material receiving conduit 160. Thereafter the operator will remove tie-off cord 126 allowing the material within the bag to fill or be drawn into the discharge chute 60. In the event it is necessary to assist in the removal of the material from the bulk bag, vibrator 90 is actuated.

What is claimed:

1. Apparatus to empty a material filled bulk bag of the type having a top, an outer liner, and having a bottom discharge spout normally closed by a releasable tie-off cord, said apparatus comprising:

an essentially vertical support frame means, a hoistable frame means removably positionable at the top of said frame;

said hoistable frame means including means to support said bulk bag within said frame;

a unitary support pan intermediately positioned within said frame to receive said bottom of said bag, said support pan tapering downwardly to a central opening;

means to vibrate said support pan;

a material receiving and conveying conduit coaxially spaced below said central opening, said conduit having dual flanges around its top;

a cylindrical sleeve attached to the bottom of said pan, said sleeve extending downwardly and coaxial about said central opening forming an annular space about said conduit, said sleeve having an access opening about a portion of its periphery;

means to withdraw air from said annular space;

drawcord means operable between said dual flanges to releasably and sealably attach the bottom end of said inner liner discharge spout to said material receiving conduit; and dual fluid actuated piston/cylinders attached to said sleeve adjacent said access opening, means on each said piston to releasably receive one end of said drawcord means.

* * * * *